United States Patent [19]

Benzaquen

[11] 3,931,427

[45] Jan. 6, 1976

[54] STAMP DYED NAPPED FABRIC

[75] Inventor: Jose Benzaquen, Caseros, Argentina

[73] Assignee: Benzaquen Sociedad Anonima Industrial, Commercial, Immobiliaria & Financiera, Argentina

[22] Filed: Oct. 12, 1973

[21] Appl. No.: 405,933

Related U.S. Application Data

[63] Continuation-in-part of Ser. No. 311,261, Dec. 1, 1972, Pat. No. 3,872,557.

[30] Foreign Application Priority Data

Nov. 23, 1972 Argentina ..... 245277

[52] U.S. Cl. ..... 428/91; 8/20; 26/29 R; 26/31; 26/37; 28/72 FT; 28/72 P; 28/74 P; 28/74 WT; 28/74 R; 428/96; 428/260; 428/262

[51] Int. Cl.[2] ..... B32B 33/00; D06C 11/00

[58] Field of Search ..... 161/64; 28/1.2, 72 FT, 28/72.1, 72.11, 74 R, 74 WT, 72 CS, 72 NW; 8/2.5, 20; 51/3, 31, 281 R; 26/29 R, 31, 37; 117/11, 76 T, 109; 428/91, 96, 260, 262

[56] References Cited

UNITED STATES PATENTS 3,650,800 3/1972 Reiner ..... 28/74

*Primary Examiner*—Marion E. McCamish
*Attorney, Agent, or Firm*—Molinare, Allegretti, Newitt & Witcoff

[57] ABSTRACT

A fabric is superficially dyed by stamping and then subjected to abrasion to produce a feltlike appearance and a simultaneous mutation in coloring.

6 Claims, No Drawings

STAMP DYED NAPPED FABRIC

CROSS REFERENCE TO RELATED APPLICATION

This application is a continuation-in-part of my copending application Ser. No. 311,261 filed Dec. 1, 1972, now U.S. Pat. No. 3,872,557 the teachings of which are incorporated by reference herein.

BACKGROUND OF THE INVENTION

The present invention relates to a process for preparing a fabric and the fabric obtained by said process. The fabric is a new industrial product with special characteristics.

In my earlier application, Serial No. 311,261, filed Dec. 1, 1972, now U.S. Pat. No. 3,872,557 the teachings of which are incorporated by reference herein, I have taught that fabrics can be submitted to a superficial abrasion process to produce a change in coloring and a feltlike appearance. In this process, the basic fabric submitted to the superficial abrasion is a fabric in which the threads, either of warp or weft or both, are superficially dyed. Superficial dyeing is necessary in order that the change in coloring in the fabric is outstanding.

SUMMARY OF INVENTION

In the present invention, the basic fabric is initially raw or untreated. That is, the warp as well as the weft threads are not dyed. Rather the color imposed on the fabric is stamped on the raw or untreated woven fabric and the colored, stamped fabric is subsequently submitted to superficial abrasion. This is in contrast to superficially dyeing the individual yarns of the fabric prior to knitting or weaving or dipping the fabric in a dye vat.

One of the principal advantages of this invention is the fact that this process is performed by dyeing a raw fabric such as unmordanted cotton, by stamping and, after superficial abrasion treatment, there is produced a fabric that, on one of its sides, presents a feltlike appearance and a simultaneous mutation in coloring, while the other side presents the original surface with the threads, either the warp and the weft, being in the same initial state.

Another advantage of this process is that when the dyeing process uses pigmented dyes it presents good resistance to light and washing and also provides a low friction surface. In the subsequent superficial abrasion stage, there is a loosening of the pigments in the binder used to bind the dye to the fibers of the fabric. By a repetition of the abrasion process a discoloration is obtained that, with the feltlike appearance produced, results in a mutation in the hue and improves the characteristics of the fabric.

When the basic raw fabric is dyed by stamping, there results color on one side of the fabric while the other side remains in the same, initial raw state.

Stamping is generally effected with reactive indanthrenes, pigmented or other direct coloring compositions well known to those trained in the art. The preferred coloring compositions for use in this process are the reactive and pigmented colorants. As indicated, these materials are well known to those trained in the art and need not be discussed in detail herein.

The reactive indanthrene coloring compositions used in stamping the fabric are characterized as chemical products that have an affinity for fiber threads wherein the colorant reacts chemically with the fibers of the fabric.

A pigmented coloring composition or dye has no affinity for the fibers in the fabric. As a consequence, it is necessary to include in the composition a binder, such as acrylic pastes, that binds the pigment to the fibers. Other binders are well known to those trained in the art and need not be discussed in detail herein. This binding operation is effected by a polymerization process by submitting the stamped fabric to a temperature in the order of 150°C for about 5 minutes.

The pigmented dyes, due to their low resistance to friction are preferred for use in this process. On the other hand, the indanthrene dyes are resistant in every aspect, that is, to light, washing, friction, etc. As a result, processing of fabrics containing these dyes is more difficult and costly than for the pigmented dyes.

For this reason, a stamping process that utilizes pigmented dyes is preferred, particularly because of its lower resistance to friction.

The stamping stage of this invention is performed with the conventional schablon system. This system, as well known to the art, is a plane or cylindrical frame that elevates a tensioned cloth or fabric relative to a graduated heddle or mesh to create a pattern on the fabric. In the present process, however, to ensure that no uneven dye marks are left on the fabric, the system may employ rotating cylinders or the plane schablon method.

DESCRIPTION OF PREFERRED EMBODIMENT

An example of the process is detailed below. Although cotton is specifically referred to other fabrics such as silk, polyesters, wool, etc. are equally suited for use in the process of the present invention.

A cotton fabric, preferably with low titer fibers, is scoured to make it almost perfectly white and susceptible to dyeing by stamping. The white fabric is then passed through a blind, rotatory schablon; that is, a smooth stamping cylinder without drawings or impressions thereon which receives from a supply cylinder, a dye based on pigments that superficially coats the fibers, that is only one side of the cloth is dyed. Suitable pigmented dyes include "Imperon" of Hoechst Chemical Co., "Acramina" of Bayer Chemical Co. and "Elizarina" of Basf Chemical Co. The fabric, thus dyed and once the pigmented surface is dry, is passed through a grinder wherein the dyed surface is submitted to superficial abrasion. This last operation may be repeated until the desired result is obtained.

The abrasion is effected by rotating cylinders with an emery coating by passing the dyed side of the fabric against the rotatory surface of the cylinders. The abrasion effect obtained besides producing a feltlike finish on the fabric surface, causes a partial loosening of the pigments in the binder that binds the pigments to the fibers. This produces a mutation in coloring that complements the feltlike appearance and leaves the reverse side of the fabric with a scoured appearance. This process is described in further detail in my application Ser. No. 311,261 filed Dec. 1, 1972, now U.S. Pat. No. 3,872,557.

I claim as my invention:

1. A process for treating the surface of a woven fabric which comprises stamping one side of a substantially crude woven textile fabric with a dye to superficially dye the surface of said one side of the fabric; and, submitting the side of the fabric thus stamped with dye to a superficial abrasion to produce a feltlike appearance and a simultaneous mutation in the coloring of said superficially dyed surface.

2. The process of claim 1, wherein said fabric is scoured and said one side of said scoured fabric is stamped by a rotating stamping cylinder containing a dye to superficially dye the fabric surface, and repeatedly superficially abrading said stamped side of the fabric to produce a feltlike appearance and a simultaneous mutation in the shade of the stamped surface.

3. The process of claim 1, wherein said stamping is effected by a plane schablon.

4. The process of claim 1, wherein said fabric is scoured and one side of said scoured fabric is stamped with a dye containing pigments.

5. A fabric having a treated surface, said fabric comprising a woven base fabric having one of its sides stamped with a dye such that the surface of said one side of the fabric is superficially dyed, said superficially dyed surface being abraded to produce a plurality of superficially raised fibrils on the threads of said superficially dyed surface resulting in a feltlike appearance and shade of dye differing from the shade of the dye stamped on said surface, and the other side of said fabric being substantially untreated.

6. The fabric of claim 5 wherein the dye present on one of the sides of the fabric contains pigments, wherein the dye pigments are attached to the fibers of the fabric with a binder, and wherein said pigments are partially loosened from said binder by abrasion to produce the differing dye shade on the stamped side of the fabric.

* * * * *